United States Patent [19]

Tillmann

[11] 4,376,323

[45] Mar. 15, 1983

[54] AUTOMATIC DOOR CLOSER

[75] Inventor: Horst Tillmann, Ennepetal, Fed. Rep. of Germany

[73] Assignee: Dorma-Baubeschlag GmbH & Co. KG, Ennepetal-Voerde, Fed. Rep. of Germany

[21] Appl. No.: 225,404

[22] Filed: Jan. 15, 1981

[30] Foreign Application Priority Data

Jan. 16, 1980 [DE] Fed. Rep. of Germany ..... 3001406

[51] Int. Cl.[3] ..... E05F 3/04

[52] U.S. Cl. ..... 16/51; 16/53; 16/71; 16/DIG. 9

[58] Field of Search ..... 16/51, 52, 53, 54, 56, 16/58, 71, DIG. 9

[56] References Cited

U.S. PATENT DOCUMENTS

| | | | |
|---|---|---|---|
| 3,852,846 | 12/1974 | Slaybaugh | 16/51 X |
| 3,875,612 | 4/1975 | Poitras | 16/51 X |
| 4,050,114 | 9/1977 | Zunkel | 16/51 X |
| 4,080,687 | 3/1978 | Jentsch | 16/56 X |
| 4,115,897 | 9/1978 | Zunkel | 16/51 X |
| 4,234,996 | 11/1980 | Jentsch | 16/58 X |
| 4,263,694 | 4/1981 | Jentsch | 16/52 X |
| 4,267,619 | 5/1981 | Suska | 16/52 X |

*Primary Examiner*—Paul A. Bell
*Attorney, Agent, or Firm*—Michael J. Striker

[57] ABSTRACT

An automatic door closer comprises a closer shaft connected to a door for turning therewith and being turnably mounted in the region of one end of an elongated fluid-filled housing. A cam disk fixed to the closer shaft cooperates over rollers carried by a slide to move the latter and a piston rod fixed thereto during opening movement of the door in a first direction. A first piston arranged in the housing divides the latter into a first and a second pressure space and is connected to the piston rod passing through a bore in the first piston for moving therewith in the first direction to thereby reduce the volume of the first pressure space while increasing the volume of the second pressure space. A coiled compression spring arranged about the piston rod biases the first piston to move in a second direction opposite said first direction. A second piston fixed to the free end of the piston rod projects beyond the first piston into a cylinder space formed in a plug closing the other end of the housing. A first plurality of interconnected throttled passages formed in the housing and the plug communicate at opposite ends with the first pressure space and the cylinder space, and a second plurality of interconnected throttled passages communicate at opposite ends respectively with said first and said second pressure space. A valve is arranged in the second plurality of interconnected passages movable between an open position permitting flow of fluid through the second plurality of interconnected passages and a closed position preventing such flow, whereby when the first piston is moved during opening of the door against the pressure of the spring, it can be held in this position by moving the valve to the closed position preventing passage of fluid through the second plurality of passages while the door can be easily turned in either direction.

9 Claims, 3 Drawing Figures

AUTOMATIC DOOR CLOSER

BACKGROUND OF THE INVENTION

The present invention relates to an automatic door closer with a closer shaft adapted to be connected to a door, and in which the closer shaft is turnably mounted in the region of the one end of an elongated housing in opposite directions from a position in which the door is closed. A cam disk is connected within the fluid-filled housing to the closer shaft for turning therewith, and this cam disk cooperates, by means of rollers fixed to a longitudinally movable slide, to move the latter in the longitudinal direction of the housing during turning of the door in either direction from the closed position. The slide is connected to a piston of a hydraulic damping arrangement and a spring arrangement forming an energy storage. The piston divides the interior of the housing into two pressure spaces which are connected to each other by channels for the throttled flow of the pressure medium from one pressure space, the volume of which is reduced during closing of the door, into the other pressure space.

With a door closer of the aforementioned type, which may be constructed as a closer mounted in an appropriate cavity in the floor, an automatic closing of the door will be obtained after each opening of the same, since the pressure medium can flow through the aforementioned channels from the pressure space, the volume of which is reduced during closing of the door, back into the other pressure space, in which the spring arrangement providing the closing force is arranged. This known door closer is provided forwardly and rearwardly of the piston with two channels, offset in the longitudinal direction of the housing, in which throttle devices are arranged through which the backflow speed of the pressure fluid from one pressure space into the other may be regulated. Thereby it is possible to dampen the first phase of the closer movement of the door to a lesser degree than the second phase of the door closing movement, so that the door will be moved without impact by the return spring to the closed position. During the opening movement of the door, the action of the throttle channels will be obviated by arranging a one-way valve in the piston which provides communication between the two pressure spaces during the closing movement of the door. However, the force of the closing spring must be overcome during the opening movement of the door. Especially at so-called fire doors which during existence of a fire have to be moved to a closed position, it is desirable that the door, during normal conditions, be easily movable, as a door without door closer, so that the door may be moved also by children without danger.

SUMMARY OF THE INVENTION

It is an object of the present invention to provide a door closer of the aforementioned kind in which the door closer function can, if desired, completely be eliminated but retaining this function in case of danger, for instance during a fire, so that normally an easy opening and closing of the door by hand is possible.

It is a further object of the present invention to construct such a door closer of relatively few and simple parts, so that the same may be manufactured at reasonable cost.

With these and other objects in view, which will become apparent as the description proceeds, the automatic door closer according to the present invention mainly comprises an elongated fluid-filled housing having a closed end and an opposite open end, a plug closing the open end of the housing, a first piston reciprocatably arranged in the housing and dividing the latter into a first pressure space adjacent the closed end of the housing and a second pressure space adjacent the plug, a closer shaft adapted to be connected to a door, extending transverse to the elongation of the housing and being turnably mounted in the housing in the region of the closed end, means connecting the closer shaft with the first piston for moving the latter, during the turning of the closer shaft in door-opening direction, in a first direction reducing the volume of the first pressure space but increasing the volume of the second pressure space, the piston-moving means comprising a piston rod slidably guided in the first piston and having a free end facing the plug, the plug being formed with a blind bore coaxial with the piston rod and having an open end facing the latter, spring means cooperating with the first piston for biasing the latter in a second direction opposite to the first direction, a second piston fixed to the free end of the piston rod and extending into the blind bore, first throttled passage means communicating at one end with the first pressure space and at the other end with a cylinder space formed between the closed end of the blind bore and the facing end of the second piston, second throttled passage means communicating at opposite ends respectively with the first and the second pressure space, and operator-controlled valve means in the second passage means movable between a closed position preventing flow of fluid through said second throttled passage means and an open position permitting flow through said second throttled passage means. The operator-controlled valve means is preferably an electromagnetically operated valve, and when the latter is moved to the closed position a pressure medium cushion will build up during the first opening of the door which will hold the first piston in the position it reaches at the end of the opening movement of the door, which will hold the first piston against the force of the spring means in the position thus arrived at. On the one hand, the door can then rest in any open position when the door is released, since the force of the closer spring is not acting. On the other hand, the door may be closed without exerting a relatively large force, since the second piston can be moved relative to the first one, and the pressure fluid has only to flow through the first throttled passage means, between the first pressure space and the cylinder space.

The aforementioned connecting means further comprise a collar arranged between the free end of the piston rod and the second piston and adapted to engage the first piston when the closer shaft is moved in door-opening direction. This collar is arranged on an end of the second piston projecting out of the blind bore and the second piston has preferably a small-diameter extension threadedly connected with the piston rod.

In order to permit a first opening of the door without any trouble, and to assure a positive closing of the door in case of danger, there are provided according to a further feature of the present invention, additional passage means connecting the aforementioned cylinder chamber with the second pressure space and a one-way valve in the additional passage means. This will assure that, during first opening of the door, pressure fluid can flow without the necessity of exertion of considerable force from the first pressure space into the second pressure space, and that the door may be closed faster than determined by the throttle in the respective throttled passage means. Preferably, the aforementioned additional passage means and the one-way valve are arranged in the second piston.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENT

Figure 1:
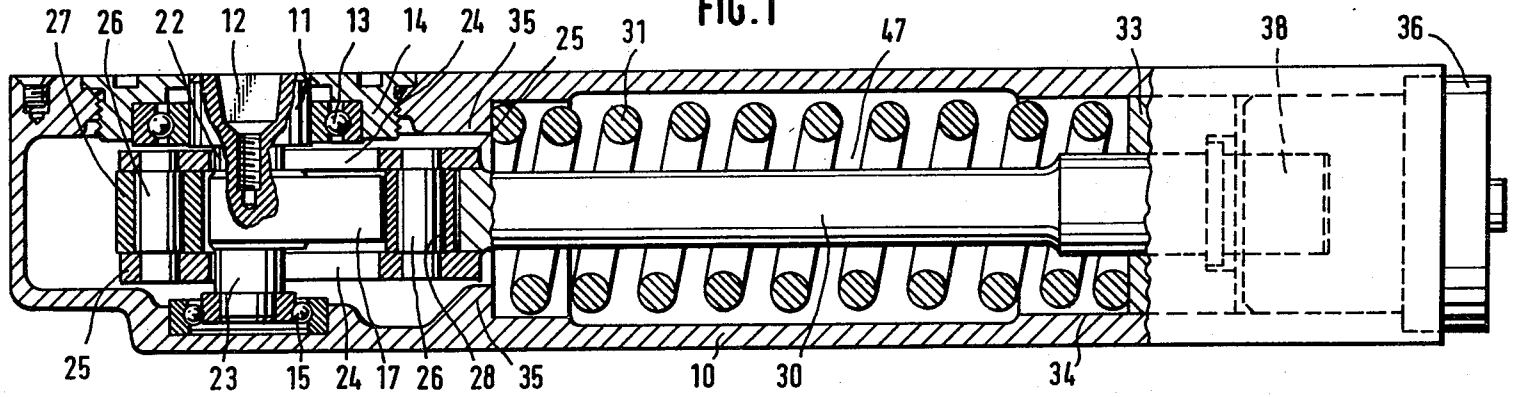
FIG. 1 is a partially sectioned side view of the door closer according to the present invention, which is illustrated in FIG. 1 in a position corresponding to the closed position of the door.
Figure 2:
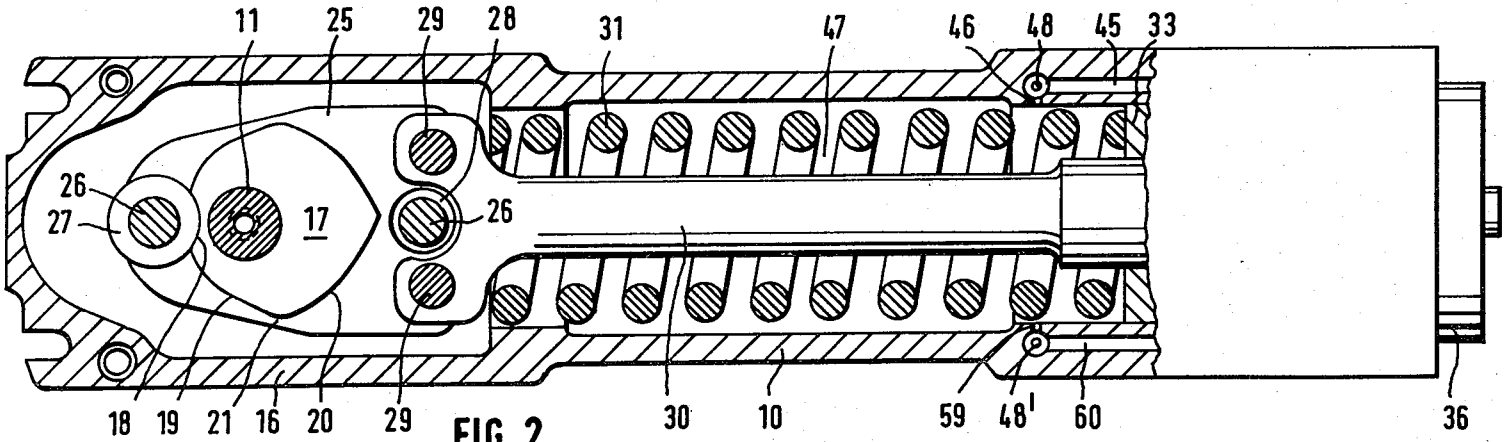
FIG. 2 is a partially sectioned top view of the door closer shown in FIG. 1.
Figure 3:
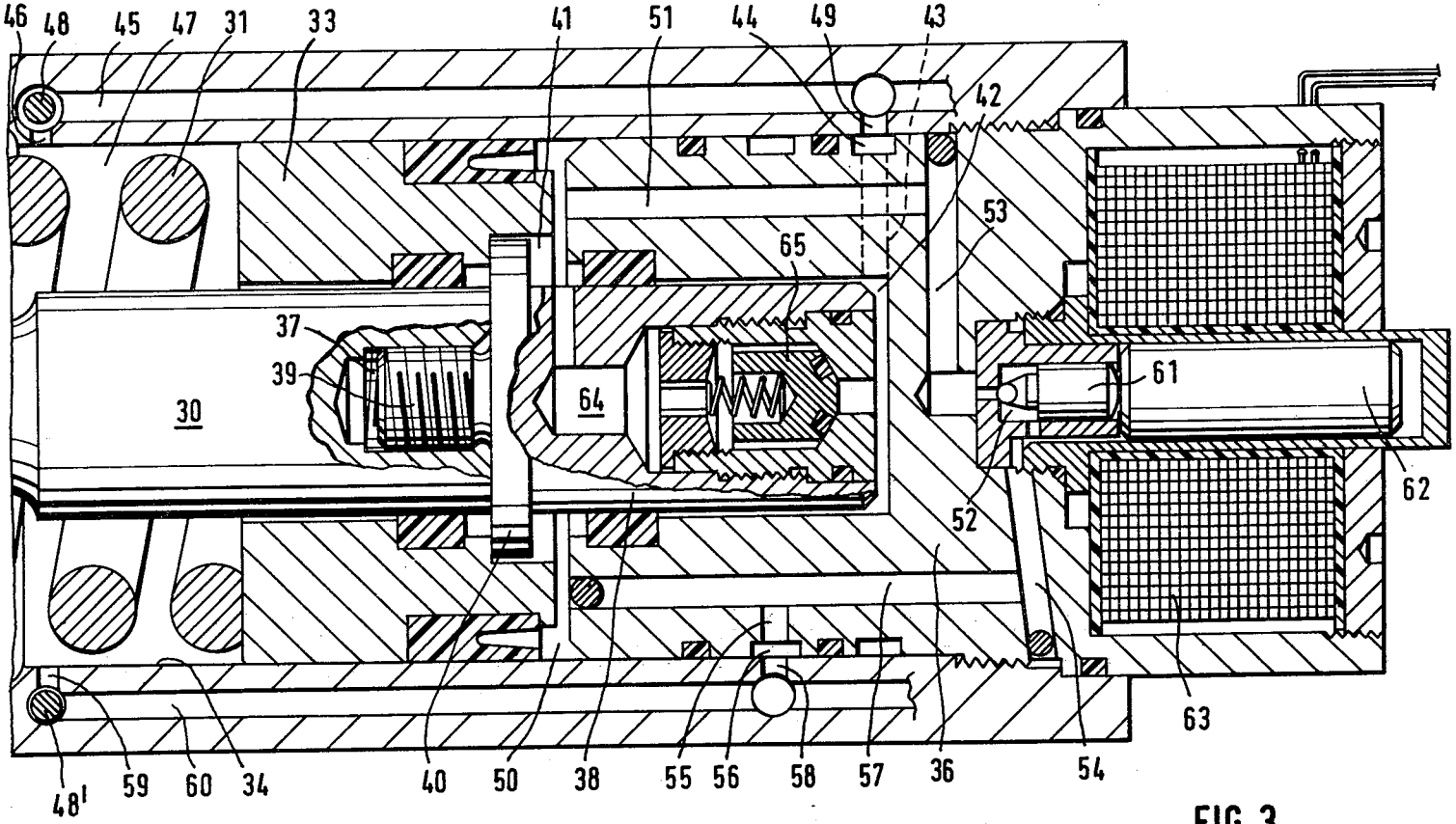
FIG. 3 illustrates the rear portion of the door closer on an enlarged scale.

The door closer according to the present invention comprises a housing 10 to be filled with pressure fluid, for instance oil. The housing 10 has a closed and and an opposite open end closed by a plug 36. A door closer shaft 11 is turnably mounted in the region of the closed end of the housing 10 extending normal to the elongation of the housing. The closer shaft 11 is provided at its upper end with a non-round recess 12 for receiving a non-illustrated pivot pin to be coupled with the door. An upper bearing 13 located in a bearing ring 14 threadedly connected with the housing, and a lower bearing 15 in the housing, turnably mount the closer shaft 11. The closer shaft is sealed by a sealing ring in the bearing ring 14. A cam disk 17 is fixed to the closer shaft 11 within the housing head space 16. The cam disk 17 has two regions mirror-symmetrically arranged with respect to a central plane thereof. The cam disk 17 is provided at its periphery with an indentation 18 determining the closed position of the door and further with two gradually rising zones 19 and 20 and a further rising zone 21. A pair of plates 25 provided with elongated guide slots 24, through which the closer shaft extends, are arranged with slight clearance with respect to the cam disk 17 in the regions 22 and 23 above and below the cam disk. The plates 25 are connected to each other by trunnions 26, the reduced-diameter portion of which are located in corresponding bores of the plates 25, whereas the large-diameter portions of the trunnions 26 respectively turnably mount rollers 27 and 28. The rollers 27 and 28 cooperate with the cam disk 17 in such a manner that the latter, in any turned position thereof, is located with slight clearance between the same. The slide formed by the plates 25 is connected with a piston rod 30, for instance by rivets 29. The piston rod 30 passes through a coiled compression spring 31 serving as an energy accumulator, and the spring 31 abuts in the region of the free end of the piston rod 30 against a first piston 33 which is sealingly reciprocatable in a cylinder bore 34 of the housing 10. The end of the spring 31 facing the closer shaft 11 engages an abutment 35 formed in the housing. The cylinder bore 34 is closed by the aforementioned closer plug 36. The piston rod 30 passes with a cylindrical end portion sealed by a sealing ring through a corresponding bore in the first piston 33 and is provided with a threaded bore 37 extending from its free end thereinto. A threaded shaft portion 39 of a second piston 38 of a diameter substantially equal to that of the piston rod 30 is threadedly connected in the threaded bore 37 of the latter. The second piston 38 is provided with a collar 40 engaging into a cut-out 41 of the first piston 33 in such a manner that the annular face of the collar 40, which is directed towards the piston 33, engages the latter during turning of the closer shaft 11 in door-opening direction to move the piston 33 against the force of the coiled compression spring 31.

The plug 36 is provided with a blind bore extending coaxial with the piston rod 30 from the end thereof facing the piston rod into the plug, and forming a cylinder chamber 42 into which the second piston 38 projects, sealed by a sealing ring at the open end of the blind bore. A radial bore 43 communicates at the inner end with the cylinder chamber 42 adjacent the closed end thereof and at the outer end with an annular groove 44 formed at the periphery of the plug 36. The annular groove 44 in turn communicates over a cross bore 46, an axial bore 45 and an additional cross bore 46 with the first pressure space 47 in which the coiled compression spring 31 is arranged. A first throttle 48 is arranged at the junction of the axial bores 45 and the cross bore 46. The radial bore 43, the annular groove 44, and the axial bore 45 together with the two cross bores 46 and 49 therefore form first throttled passage means providing communication between the cylinder chamber 42 and the first pressure space 47 in which the coiled compression spring 31 is arranged. Second throttled passage means providing communication between the first pressure space 47 and the second pressure space 50 formed between facing ends of the piston 33 and the plug 36 are formed by a longitudinal bore 51 in the plug 36 communicating at one end with the second pressure space 50 and at the other end with a radial bore 53 which in turn communicates with a valve chamber 52, and the latter communicates with an other radial bore 54 which in turn communicates over a cross bore 55 with another annular groove 56 formed at the periphery of the plug, which in turn communicates over cross bores 58 and 59 and a longitudinal bore 60 with the first pressure space, whereby a second throttle 48' is arranged at the junction of the bores 60 and 59. A valve member 61, arranged in the valve chamber 52, is movable between a closed position preventing flow of fluid through the second throttled passage means from the second pressure space 50 to the first pressure space 47, and an open position permitting such flow. The valve member abuts in its closed position against the armature 62 of an electromagnet 63 arranged in the plug 36 rearwardly of the valve member 61.

Additional passage means 64 through the second piston 38 connect the second pressure space 50 with the cylinder chamber 42, and a spring-biased one-way valve 65 is arranged in this additional passage means 64 permitting flow of pressure fluid from the cylinder chamber 42 connected by the first throttled passage means with the first pressure space 47 to the second pressure space 50 when the first piston 33 is moved in door-opening direction by the collar 40 and the piston rod 30, and when this movement of the piston is carried out by an outer force faster than permitted by the throttle 48.

The above-described door closer may be operated as follows:

If the electromagnet 63 is energized, the valve member 61 in the valve chamber 52 will be held in the closed position, so that pressure fluid cannot pass between the first pressure space 47 and the second pressure space 50 over the second throttled passage means including the valve chamber 52. If the door closer is now moved during the first opening of the door from the position shown in the drawing, the piston rod 30 is moved towards the left, as viewed in the various Figures, so as to move the first piston 33 by means of the collar 40 against the force of the spring 31. Thereby pressure fluid will be displaced from the first pressure space 47 and flow over the channel 46, 45, 49, 44 and 43, first into the cylinder chamber 42 and from there, due to the thus forming overpressure, over the one-way valve 65 and the channel 64 into the second pressure space 50. When now thereafter, at the end of the door-opening movement, the door is released, there will be created, due to the force of the coiled compression spring 31, such a pressure in the second pressure space 50 that the piston 33 will remain in the position it has reached during the door-opening movement, since the pressure fluid could flow only back into the first pressure space 47 over the second throttled passage means containing the valve chamber 52 which, however, are closed by the valve member 61. When the piston 33 is thus held as described above, the door may be easily closed or opened, since the second piston 38, together with the piston rod, may easily reciprocate because the pressure fluid in the valve chamber 52 may flow over the channel means 43, 44, 49, 45 and 46 and the throttling device 48 into or out of the first pressure space 47. The compression spring 31 can press the piston 33 and therewith the piston rod 30 over the collar 40 back to the position as shown in the drawing, only when the valve member 61 is released by deenergizing the electromagnet 63, so that the pressure fluid can flow over the now opened channel 51, 53, 54, 57, 55, 56, 58, 60 and 59 from the second pressure space 50 into the first pressure space 47, throttled by the throttling device 48'. The deenergizing of the electromagnet 63, to permit the valve member 61 to move from the closed to the open position, may be carried out automatically, for instance by a smoke detector or the like, or by a manually actuated switch or the like.

It will be understood that each of the elements described above, or two or more together, may also find a useful application in other types of automatic door closers differing from the types described above.

While the invention has been illustrated and described as embodied in an automatic door closer in which the automatic closer function of the door closer may be eliminated so that the door may be easily moved by hand between an open and a closed position, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An automatic door closer comprising an elongated fluid-filled housing having a closed end and an opposite open end; a plug closing said open end of said housing; a first piston reciprocatably arranged in said housing and dividing the latter into a first pressure space adjacent said closed end and a second pressure space adjacent said plug; a closer shaft adapted to be connected to a door, extending transverse to the elongation of said housing and being turnably mounted in said housing in the region of said closed end; means connecting said closer shaft with said first piston for moving the latter, during turning of the closer shaft in door-opening direction, in a first direction reducing the volume of said first pressure space while increasing the volume of said second pressure space, said piston-moving means comprising a piston rod slidingly guided in said first piston and having a free end facing said plug, said plug being formed with a blind bore coaxially with said piston rod and having an open end facing the latter; spring means cooperating with said first piston for biasing the latter in a second direction opposite to said first direction; a second piston fixed to the free end of said piston rod and extending into said blind bore; first throttled passage means communicating at one end with said first pressure space and at the other end with the cylinder space formed between the closed end of said blind bore and the facing end of said second piston; second throttled passage means communicating at opposite ends respectively with said first and said second pressure space; and valve means in said second throttled passage means movable between a closed position preventing flow of fluid through said second passage means and an open position permitting flow of fluid through said second passage means.

2. An automatic door closer as defined in claim 1, wherein said connecting means further include a cam disk connected to said closer shaft for turning therewith and a slide carrying a pair of rollers cooperating with said cam disk for moving said slide in longitudinal direction during turning of said cam disk, said piston rod being fixed to said slide for movement therewith.

3. An automatic door closer as defined in claim 1, wherein said spring means comprises a coiled compression spring arranged in said first pressure space about said piston rod and abutting with opposite ends against said first piston and an abutment in said housing.

4. An automatic door closer as defined in claim 1, wherein said connecting means further include a collar arranged between said free end of said piston rod and the second piston and adapted to engage said first piston when the latter is moved by said connecting means in said first direction.

5. An automatic door closer as defined in claim 4, wherein said collar is arranged on an end of said second piston projecting out of said blind bore.

6. An automatic door closer as defined in claim 5, wherein said second piston has a small-diameter extension threadedly connected with said piston rod.

7. An automatic door closer as defined in claim 1, and including additional passage means connecting said blind bore in the region of the closed end thereof with said second pressure space and a one-way valve in said additional passage means.

8. An automatic door closer as defined in claim 7, wherein said additional passage means and said one-way valve are arranged in said second piston.

9. An automatic door closer as defined in claim 1, wherein said valve means is an electromagnetically operated valve.

* * * * *

UNITED STATES PATENT AND TRADEMARK OFFICE

CERTIFICATE OF CORRECTION

PATENT NO. : 4,376,323

DATED : March 15,1983

INVENTOR(S) : Horst Tillmann

It is certified that error appears in the above—identified patent and that said Letters Patent is hereby corrected as shown below:

Column 5, lines 31 and 32, cancel "valve chamber 52" and substitute -- cylinder chamber 42--

Signed and Sealed this

*Twenty-fourth* Day of *July 1984*

[SEAL]

*Attest:*

GERALD J. MOSSINGHOFF

*Attesting Officer*

*Commissioner of Patents and Trademarks*